US005253858A

United States Patent [19]

Grieve

[11] Patent Number: 5,253,858

[45] Date of Patent: Oct. 19, 1993

[54] DEVICE FOR SINGLY SEPARATING OR SINGLING OUT STACKED PRINTING FORMS

[75] Inventor: Martin Grieve, Heidelberg-Ziegelhausen, Fed. Rep. of Germany

[73] Assignee: Heidelberger Druckmaschinen AG, Heidelberg, Fed. Rep. of Germany

[21] Appl. No.: 886,504

[22] Filed: May 20, 1992

[30] Foreign Application Priority Data

May 21, 1991 [DE] Fed. Rep. of Germany ..... 4116491

[51] Int. Cl.[5] ..... B65H 3/08

[52] U.S. Cl. ..... 271/103; 271/107; 271/108

[58] Field of Search ..... 271/11, 103, 107, 108; 294/64.1; 221/211

[56] References Cited

U.S. PATENT DOCUMENTS

| | | | |
|---|---|---|---|
| 3,154,306 | 10/1964 | Elliott et al. | 294/64.1 X |
| 3,195,941 | 7/1965 | Morey | 294/64.1 |
| 4,351,518 | 9/1982 | Stievenart | 294/64.1 X |
| 4,508,331 | 4/1985 | Kashiwagi | 271/107 |
| 4,749,219 | 6/1988 | Bolle, Jr. et al. | 271/103 X |
| 4,784,380 | 11/1988 | Eberle | 271/103 |

FOREIGN PATENT DOCUMENTS

| | | | |
|---|---|---|---|
| 63-112336 | 5/1988 | Japan . | |
| 865376 | 4/1961 | United Kingdom | 271/103 |

*Primary Examiner*—David H. Bollinger

*Attorney, Agent, or Firm*—Herbert L. Lerner; Laurence A. Greenberg

[57] ABSTRACT

A device for singly separating stacked sheet-like elements, includes at least one sucker for applying vacuum, the sucker being deformable for varying the volume thereof, and a vertically and rotatably displaceable holder formed with an inner air duct and having a lower end at which the sucker is disposed. Further included are a closure device controllable in accordance with a given operating cycle for opening and closing the air duct, a drive device for vertically and rotatingly displacing the holder, a support operatively coupled with the drive device and having a guide device for guiding the displaceable holder substantially perpendicularly to a suction surface of the sucker and between respective stops at spaced-apart locations of the guide device, and a resilient device for biasing the holder in a direction towards a lower end position thereof. Moreover, the holder is formed with a sensing surface at the lower end thereof and within the deformable sucker for cooperating with an upper surface of a respective uppermost sheet-like element of a stack of sheet-like elements.

10 Claims, 2 Drawing Sheets

DEVICE FOR SINGLY SEPARATING OR SINGLING OUT STACKED PRINTING FORMS

The invention relates to a device for singly separating stacked printing forms and similar sheet stock formed of paper, plastic, aluminum or the like.

A device of the foregoing general type has become known heretofore from Japanese Published Non-Prosecuted Application (Sho) 63-112336 which functions without a suction-air connection and has structural features for accepting and transferring sheet stock, particularly photographs. Due to the deformation of a sucker, vacuum is generated in the sucker for suction-gripping a piece of sheet stock. When the sucker is deformed, the air in the sucker escapes through an air duct having a closure member which is opened in accordance with an operating cycle or stroke, and closed after the piece of sheet stock has been suction-gripped. The sucker swivels with the suction-gripped piece of sheet stock into a transfer position in which the piece of sheet stock is released for further transport by the opening of the closure member. The closure member is opened and closed by a swivelable flap, which is movable by driving means into a closing position against the upper end of the air duct in the holder, and into an opening position. The sucker then swivels back into the starting position thereof in order to take up the next piece of sheet stock. To enable this heretofore known device to take effect, it is necessary for the piece of sheet stock which is to be suction-gripped by the sucker always to be in the same position. This calls, therefore, for precautionary measures to ensure that the piece of sheet stock which is to be suction-gripped is always held ready in the same position. With the device of the heretofore-known construction, such precautionary action is manifested by having the sucker strike, with a more-or-less horizontally aligned swiveling motion, against a piece of sheet stock vertically held ready in order to suction-grip the latter. This heretofore-known device is not suitable for singling out or singly separating stacked printing forms or the like, because it does not compensate for the changed height of the stack after each printing form has been removed from the stack.

It is accordingly an object of the invention to provide a device for singly separating stacked sheet-like elements such as printing forms and like sheet stock, which is of as simple a construction as possible and independent of a suction-air connection, and which automatically adapts to varying stack height and compensates for differences in such a varying stack height.

With the foregoing and other objects in view, there is provided, in accordance with the invention, a device for singly separating stacked sheet-like elements, comprising at least one sucker for generating a vacuum, the sucker being deformable for varying the volume thereof, a vertically and rotatably displaceable holder formed with an inner air duct and having a lower end at which the sucker is disposed, closure means controllable in accordance with a given operating cycle for opening and closing the air duct, drive means for vertically and rotatingly displacing the holder, a support operatively coupled with the drive means and having guide means for guiding the displaceable holder substantially perpendicularly to a suction surface of the sucker and between respective stops, resilient means for biasing the holder in a direction towards a lower end position thereof, the holder being formed with a sensing surface at the lower end thereof and within the deformable sucker for cooperating with an upper surface of a respective uppermost sheet-like element of a stack of sheet-like elements.

An essential feature of the invention is the disposition of the sucker on a holder guided in a support between stops, the support being connected to a drive, and the movable guidance being perpendicularly to the suction area of the sucker, the holder being formed with a sensing surface within the sucker, the sensing surface cooperating with a surface of the uppermost printing form in the stack. The lowering movement of the sucker is thereby limited in adapting to the respective stack height, and relative motion between the holder and the support against a spring biasing action is ensured so that, in spite of varying stack heights, the support is always able to perform the same motion.

In accordance with another feature of the invention, the closure means comprise a shut-off valve located at an upper end of the holder and having a valve member for closing the air duct, the valve member being actuatable for automatically opening the air duct when there is excess pressure in the air duct, and for forcibly opening the air duct in accordance with the given operating cycle.

In accordance with a further feature of the invention, the stops are spaced apart a distance displaceable by the ram which is at least equal to a maximum height of the stack of sheet-like elements.

In accordance with an added feature of the invention, the stops are formed on the ram at respective outer locations thereof, the guide means defining a passageway formed in the support through which the ram extends, and the resilient means comprising a helical spring surrounding the ram and braced between the support and one of the stops for urging the ram into the lower end position wherein it engages the uppermost sheet-like element of the stack of sheet like elements.

In accordance with an additional feature of the invention, there is provided a housing wherein the valve member is displaceably mounted, spring means disposed in the housing for biasing the valve member into a position for closing the shut-off valve, and means for displacing the valve member against the bias of the spring means for forcibly opening the shut-off valve, the displacing means comprising a swivelable spring bracket mounted on the housing and engageable with a fixed stop.

In accordance with yet another feature of the invention, the swivelable spring bracket is formed as a double-armed lever having one arm thereof operatively engageable with the valve member, and the other arm thereof operatively engageable with the fixed stop.

In accordance with yet a further feature of the invention, the sucker is formed with a sealing lip engageable with the upper surface of the respective uppermost sheet-like element.

In accordance with yet an added feature of the invention, the sealing lip is a multiple sealing lip.

In accordance with yet an additional feature of the invention, there is provided a device for stacking a multiplicity of sheet-like elements consisting of printing forms which are to be singly separated.

In accordance with a concomitant feature of the invention, there are provided transport rollers for gripping the respective singly separated sheet-like elements and transporting them onward.

Due to the application of the features according to the invention, the advantages of a relatively simply constructed device for singly separating stacked sheet-like elements such as printing forms and the like having a sucker which is completely independent of a suction-air source are combined with the advantages of means for automatically sensing different stack heights and adapting to the respective existing stack height. The vacuum in the sucker for suction-gripping the uppermost sheet-like element, i.e., printing form, in the stack is generated by deforming the sucker. The vacuum is removed by opening a valve, preferably at the end of a movement of the sucker caused by an actuating element which is brought into engagement with a fixed stop. In order to ensure a sealing of the sucker when the respective sheet-like element or printing form is suction-gripped, a double sealing lip is provided at the edge of the sucker.

The device according to the invention can be employed to special advantage for working with materials impermeable to air, particularly for printing forms made of plastic material, aluminum or the like. The compact construction of the device according to the invention affords relatively simple installation and removal thereof for the purpose of maintenance, replacement of parts or the like.

Other features which are considered as characteristic for the invention are set forth in the appended claims.

Although the invention is illustrated and described herein as embodied in a device for singly separating or singling out stacked printing forms, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
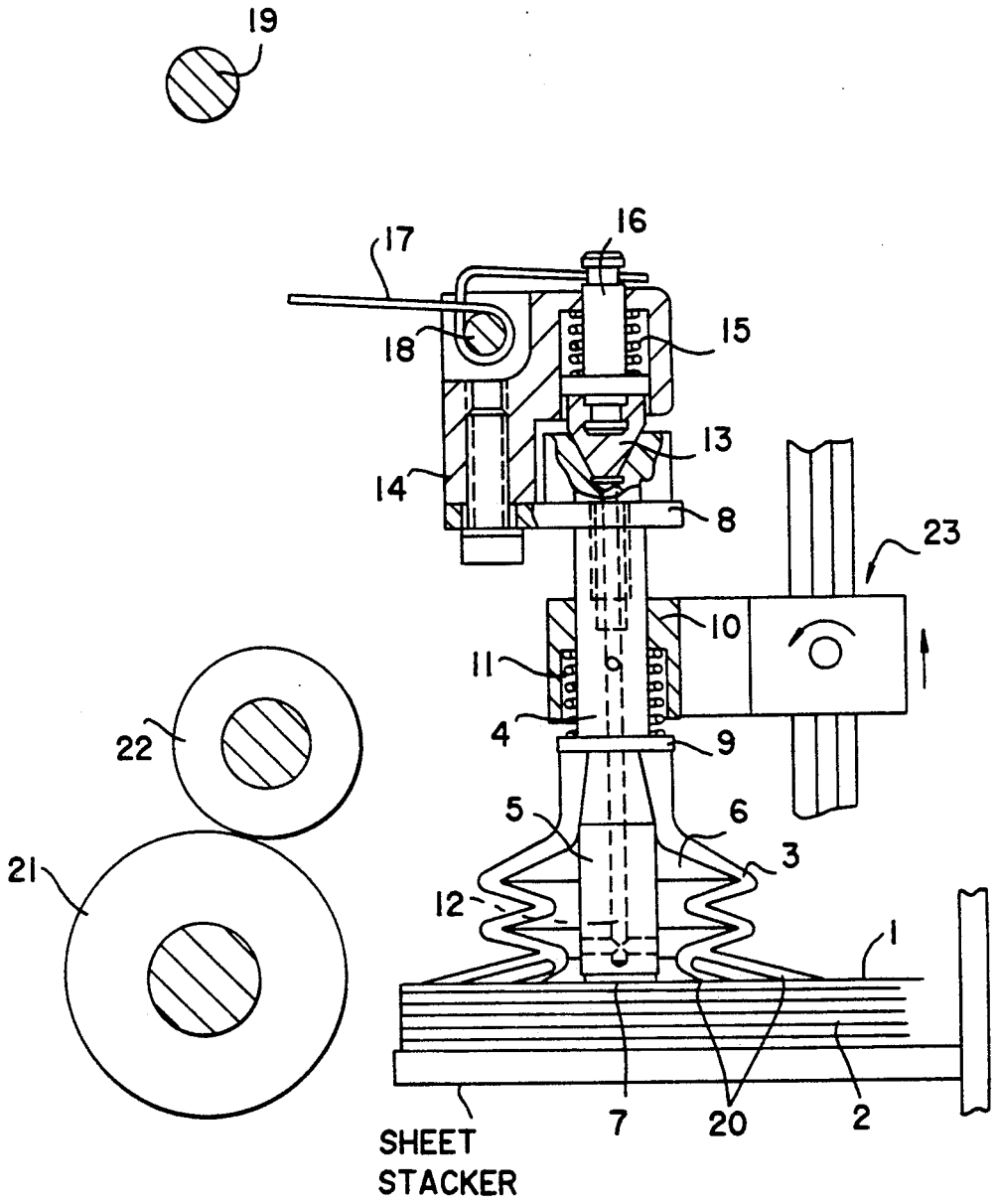
FIG. 1 is a vertical sectional view of the device for singly separating stacked printing forms in a first operating phase thereof, namely in a suction-gripping position.
Figure 2:
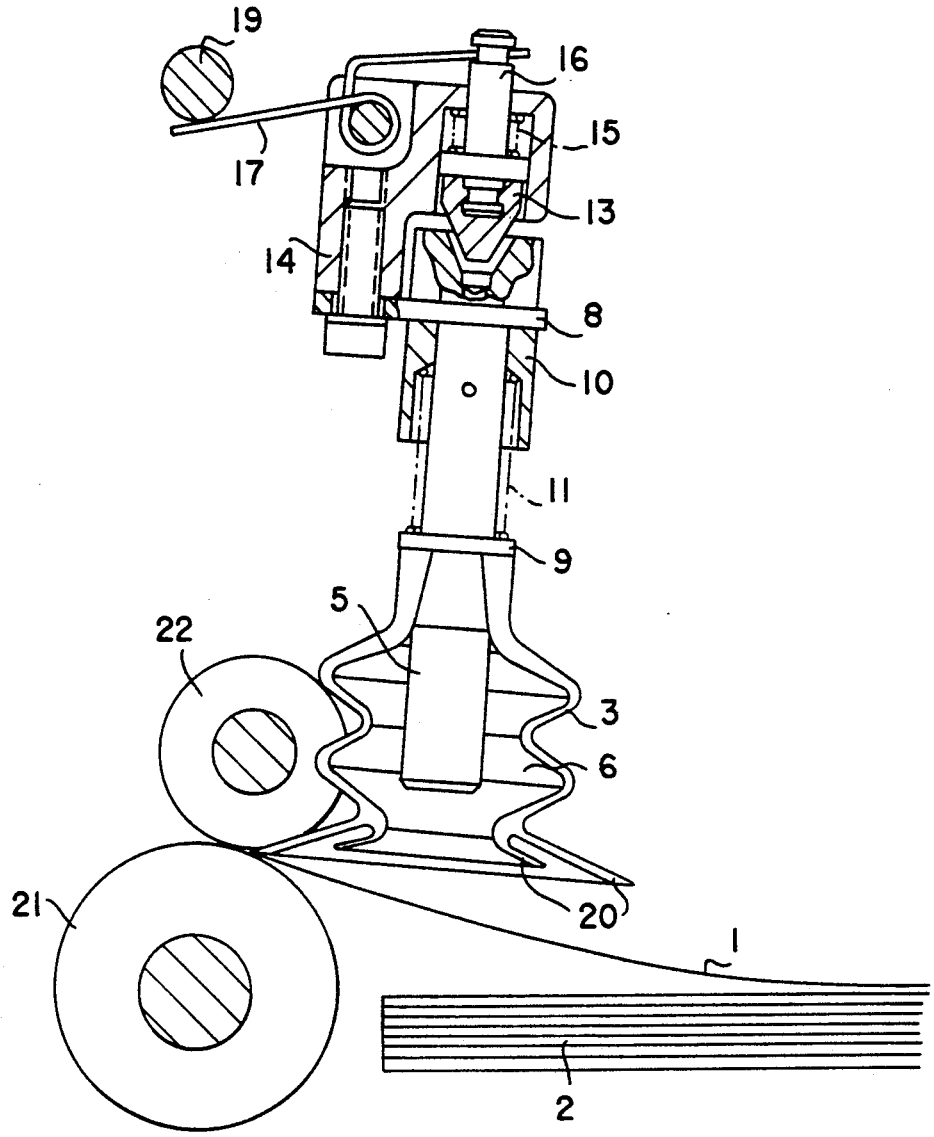
FIG. 2 is a view of the device of FIG. 1 in a second operating phase thereof, namely in a transfer position.

Referring now to the drawing and, first, particularly to FIGS. 1 and 2 thereof, there is shown therein the device according to the invention for singling out or singly separating printing forms 1 in a pile or stack 2 which includes a sucker 3 attached to a ram or holder 4 and enclosing a lower end 5 of the ram 4. The lower end 5, which projects into the interior 6 of the sucker 3, is formed with a contact or sensing surface 7 which cooperates with a surface of the uppermost printing form 1 in the sheet pile 2. The ram 4 is axially movably guided in a support 10 such as a beam or bracket between stops 8 and 9 disposed on the outside of the ram 4, and is resiliently biased in a downward direction, as viewed in FIGS. 1 and 2, by a helical spring 11 which surrounds the ram 4 so that the spring 11 presses the ram 4 and, accordingly, the stop 8 against a stop surface on the support 10. The support 10 is movably held in the machine and is connected to a conventional drive 23, such as that of a feeder device, which transmits swiveling and reciprocating motions to the support 10. The spring 11 is braced, at one end thereof, against the support 10 and, at the other end thereof, against the stop 9 on the ram 4. Formed within the ram 4 is an air duct 12 which, at one end thereof, terminates in the interior 6 of the sucker 3 and, at the other end thereof, cooperates with a shutoff valve at an upper end of the ram 4. The shutoff valve is formed of a conical valve body 13 and a complementarily conical valve seat provided in the upper end of the ram 4. The valve body 13 is axially movable against the force of a weak spring 15 in a housing 14 rigidly connected to the ram 4, the spring 15 having such a limited strength that, when excess pressure is generated in the interior 6 of the sucker due to the deformation of the latter, the valve cone 13 lifts off its seating surface, and the air in the sucker 3 is able to escape. A pin 16, which passes through the spring 15 and is connected to the valve body 13, extends out of the housing 14 and is connected to an end of one arm of a double-armed spring bracket 17. The spring bracket 17 is mounted on the housing 14 so as to be able to swivel about a pin 18 and has another arm which cooperates with a stop 19 fixed to a machine frame so as to lift the valve body 13 away from its seating surface when in a sheet or form transfer position, and so as to remove or eliminate the vacuum in the sucker 3.

Figure 3:
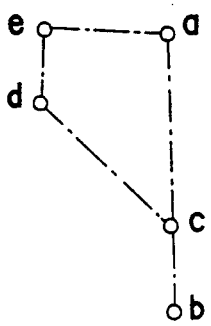
FIG. 3 is a diagram illustrating a sequence of motions of the sucker into various phases of operation thereof.

In a rest position, the spring 11 holds the ram 4 with the stop 8 against the upper side of the support 10 (note FIG. 2). In a first operating phase, the support 10 moves vertically downwards, so that, in the diagram of motions shown in FIG. 3, the support 10 is moved out of position a into position b. Depending upon the respectively prescribed height or level of the pile or stack 2 of printing forms 1, the sensing surface 7 of the ram 4 makes contact with the surface of the uppermost printing form 1 in the pile 2 and causes a displacement of the ram 4 relative to the support 10 against the biasing action of the spring 11. When the support 10 and the sucker 3 are lowered, a deformation of the sucker 3 occurs the instant a suction lip 20 of the sucker 3 comes into contact with the uppermost printing form 1. In order to achieve reliable sealing, the suction lip 20 of the sucker 3 is provided, in the illustrated embodiment, as a double sealing lip. Air which is displaced out of the interior 6 of the sucker 3 through an air duct 12 in the ram 4 upon the deformation of the sucker 3 lifts the valve cone closure member 13 off its seating surface against the action of the spring 15, in order to reduce the excess pressure in the sucker 3. Due to a suitably controlled movement of the support 10, the sucker 3 is then raised together with the suction-gripped uppermost printing form 1 out of position b (FIG. 3) into position c before a swiveling movement to position d occurs, which corresponds to a transfer position to further-conveying transport means. Additionally illustrated in FIGS. 1 and 2 of the drawing are two transport rollers 21 and 22, which grip the printing form 1 by the edge thereof which is pushed into the nip between the two transport rollers 21 and 22. Simultaneously, due to the motion of the support 10, a further stroke movement occurs, so that one arm of the spring bracket 17 comes into engagement with a fixed stop 19, and the valve cone or body 13 is thereby lifted off its seating surface in the ram 4 and the vacuum in the sucker 3 is reduced or eliminated so that the sucker 3 releases the suction-gripped printing form 1 in a lifted or raised position e and then returns to the starting position a in order to lift off the next printing form. The view of FIG. 1 corresponds to that of the sucker position b in FIG. 3, and the view of FIG. 2 corresponds to that of the sucker position e in FIG. 3.

The foregoing is a description corresponding in substance to German Application P 41 16 491.1, dated May 21, 1991, the International priority of which is being claimed for the instant application, and which is hereby made part of this application. Any material discrepancies between the foregoing specification and the aforementioned corresponding German application are to be resolved in favor of the latter.

I claim:

1. Device for singly separating stacked sheet-like elements, comprising at least one sucker for applying vacuum, said sucker being deformable for varying the volume thereof, a vertically and rotatably displaceable holder formed with an inner air duct and having a lower end at which said sucker is disposed, closure means controllable in accordance with a given operating cycle for opening and closing said air duct, drive means for vertically and rotatingly displacing said holder, a support operatively coupled with said drive means and having guide means for guiding said displaceable holder substantially perpendicularly to a suction surface of said sucker and between respective stops at spaced-apart locations of said guide means, resilient means for biasing said holder in a direction towards a lower end position thereof, said holder being formed with a sensing surface at said lower end thereof and within said deformable sucker for cooperating with an upper surface of a respective uppermost sheet-like element of a stack of sheet-like elements.

2. Device according to claim 1, wherein said closure means comprise a shut-off valve located at an upper end of said holder and having a valve member for closing said air duct, said valve member being actuatable for automatically opening said air duct when there is excess pressure in said air duct.

3. Device according to claim 2, including a housing wherein said valve member is displaceably mounted, spring means disposed in said housing for biasing said valve member into a position for closing said shut-off valve, and means for displacing said valve member against the bias of said spring means for forcibly opening said shut-off valve, said displacing means comprising a swivelable spring bracket mounted on said housing and engageable with a fixed stop disposed adjacent to said housing.

4. Device according to claim 3, wherein said swivelable spring bracket is formed as a double-armed lever having one arm thereof operatively engageable with said valve member, and the other arm thereof operatively engageable with said fixed stop.

5. Device according to claim 1, wherein said stops are spaced apart a distance traversible by said holder which is at least equal to a maximum height of said stack of sheet-like elements.

6. Device according to claim 1, wherein said stops are formed on said holder at respective outer locations thereof, said guide means defining a passageway formed in said support through which said holder extends, and said resilient means comprising a helical spring surrounding said holder and braced between said support and one of said stops for urging said holder into said lower end position wherein it engages the uppermost sheet-like element of said stack of sheet like elements.

7. Device according to claim 1, wherein said sucker is formed with a sealing lip engageable with the upper surface of the respective uppermost sheet-like element.

8. Device according to claim 7, wherein said sealing lip is a multiple sealing lip.

9. Device according to claim 1, in combination with a device for stacking a multiplicity of sheet-like elements consisting of printing forms which are to be singly separated.

10. Device according to claim 1, in combination with transport rollers for gripping the respective singly separated sheet-like elements and transporting them onward.

* * * * *

UNITED STATES PATENT AND TRADEMARK OFFICE

CERTIFICATE OF CORRECTION

PATENT NO. : 5,253,858

DATED : October 19, 1993

INVENTOR(S) : Martin Greive

It is certified that error appears in the above-indentified patent and that said Letters Patent is hereby corrected as shown below:

On the Title Page, Item [75], change "Grieve" to --Greive--.

Signed and Sealed this

Tenth Day of May, 1994

*Attest:*

*Attesting Officer*

BRUCE LEHMAN

*Commissioner of Patents and Trademarks*